US006408818B1

(12) United States Patent
Tadashi

(10) Patent No.: US 6,408,818 B1
(45) Date of Patent: Jun. 25, 2002

(54) INTAKE AIR FLOW RATE CONTROLLING DEVICE

(75) Inventor: Tsubakiji Tadashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/660,485

(22) Filed: Sep. 12, 2000

(30) Foreign Application Priority Data

May 23, 2000 (JP) ..... 2000-151644

(51) Int. Cl.[7] ..... F02D 11/10
(52) U.S. Cl. ..... 123/399; 123/198 D
(58) Field of Search ..... 123/399, 361, 123/198 D; 73/118.2, 118.1

(56) References Cited

U.S. PATENT DOCUMENTS 4,581,924 A * 4/1986 Otobe et al. ..... 73/118
5,343,840 A * 9/1994 Wataya et al. ..... 123/399
5,355,972 A * 10/1994 Wataya ..... 180/68.3
5,477,826 A * 12/1995 Hara et al. ..... 123/339.16
5,578,749 A * 11/1996 Mogaki ..... 73/118.1
5,586,534 A * 12/1996 Fujimoto ..... 123/325
5,787,861 A * 8/1998 Suzuki et al. ..... 123/396
5,927,250 A * 7/1999 Nishida ..... 123/399
6,009,371 A 12/1999 Kobayashi ..... 701/112
6,092,505 A * 7/2000 Takahashi et al. ..... 123/399

FOREIGN PATENT DOCUMENTS

| | | | | |
|---|---|---|---|---|
| DE | 690 01 567 | | 8/1993 | |
| DE | 196 15 672 | | 2/1997 | |
| JP | 74845 | * | 5/1983 | ..... F02D/29/02 |
| JP | 05 133 269 | | 5/1993 | |
| JP | 293284 | * | 11/1995 | ..... F02D/29/02 |

* cited by examiner

*Primary Examiner*—Tony M. Argenbright
*Assistant Examiner*—Hai Huynh
(74) *Attorney, Agent, or Firm*—Sughrue Mion, PLLC

(57) ABSTRACT

A completely closing position detecting and correcting device 11 detecting a stop of operation of the combustion engine, controlling the throttle valve 3 to be in a completely closing position, detecting the completely closing position, and correcting the target position signal outputted from the target opening degree setting device 9 in a completely closing state by shifting the target position signal on a side of opening from an actual completely closing position by a predetermined amount, whereby even though the detected value from the throttle valve opening degree detecting sensor has an error at time of completely closing the throttle valve, a trouble is not caused.

3 Claims, 6 Drawing Sheets

INTAKE AIR FLOW RATE CONTROLLING DEVICE

BACKGROUND OF THE INVENTION

1. Field of the Invention

The present invention relates to an intake air flow rate control device for controlling an intake air flow rate for an internal combustion engine by operating a throttle valve driven by a motor.

2. Discussion of Background

According to a conventional technique, in a combustion engine equipped in a conventional vehicle, a throttle valve located in an intake air passage is connected to an accelerator pedal by a mechanical means such as a linkage mechanism and a cable, and an opening degree of the throttle valve is operated in association with an amount of stepping the accelerator pedal, whereby the intake air flow rate is controlled. By a control of the intake air flow rate by the mechanical means, the amount of stepping the accelerator pedal and the opening degree of the throttle valve are univocally determined, a control of the throttle valve using elements other than the amount of stepping the accelerator pedal is difficult, and a degree of freedom of a relationship between positions of the accelerator pedal and the throttle valve in the vehicle is limited.

Therefore, in recent years, an intake air flow rate controlling device of an electronic control type is popularly used, wherein the controlling device makes a throttle valve open and close by a driving force of a motor, an amount of stepping an accelerator pedal is electrically detected, and the throttle valve is driven by the motor based on thus detected amount. The intake air flow rate controlling device of the electronic control type controls the motor by receiving various signals other than the amount of stepping the accelerator pedal to enable an operation of opening and closing the throttle valve, and various running conditions are used as inputs into the controlling device to control the throttle valve.

For example, in a gasoline engine of a direct cylinder injection type, an air fuel ratio is widely changed from a theoretical air fuel ratio to an air fuel ratio for lean burn. However, there is a large difference between torques generated by an internal combustion engine under the theoretical air fuel ratio and the air fuel ratio for lean burn when an opening degree of the throttle valve is the same. At a time when the air fuel ratio for lean burn is changed to the theoretical air fuel ratio, it is necessary to correct the intake air flow rate by controlling the opening degree of the throttle regardless of the amount of stepping the accelerator pedal in order to restrict a variation of the torques, whereby the electronically controlled intake air flow rate controlling device is indispensable to such an internal combustion engine.

The electronically controlled intake air flow rate controlling device obtains a present opening degree of the throttle valve by receiving a value detected by a throttle valve opening degree detecting sensor located in the throttle valve, operates a target opening degree of the throttle valve with respect to the present opening degree, and drives the motor. However, an error in the detection and so on make a difference between the detected value by the throttle valve opening degree detecting sensor and an actual throttle valve opening degree, and the difference varies depending on a change of an ambient temperature and so on. For example, when the throttle valve is controlled to be completely closed, the throttle valve is actually in a completely closing position, the detected value of the throttle valve opening degree detecting sensor is not in conformity with the completely closing position. Therefore, the controlling device continuously drives the motor and increases the driving current to completely close the throttle valve, whereby there is a possibility that the motor and/or a motor driving circuit is burned out.

In order to previously avoid such troubles, in the conventional intake air flow rate controlling device of the electronic control type, the completely closing position of the throttle valve is learned from the detected value by the throttle valve opening degree detecting sensor, and a lower limit value of the target throttle valve opening degree is used as the learned value of the completely closing position. However, the learned value still has an error. Further, when the detected value from the sensor of the throttle valve opening degree is changed by a variation and so on of an ambient temperature, a difference may occur between the learned value and the detected value, whereby it was impossible to completely prevent the motor and the motor driving circuit from burning out. Further, a problem similar to those described may occur at time of completely opening the throttle valve besides the time of completely closing the throttle.

SUMMARY OF THE INVENTION

It is an object of the present invention to solve the above-mentioned problems inherent in the conventional technique and to provide an intake air flow rate controlling device of an electronically control type, which is not troubled even in case that a difference occurs between a detected value from a throttle opening degree sensor and an actual position of a throttle valve when the throttle valve is completely closing or completely opening.

According to the first aspect of the present invention, there is provided an intake air flow rate controlling device comprising: a throttle valve located in an intake air passage of a combustion engine; a motor controlling an intake air flow rate by operating an opening degree of the throttle valve; a motor driving means driving the motor; a throttle valve opening degree detecting sensor; a target opening degree setting means operating a target throttle valve opening degree, setting the opening degree of the throttle valve, and outputting the target throttle value opening degree as a target position signal to the motor driving means; a throttle valve completely closing position learning means learning a completely closing position of the throttle valve from a completely closing position signal from the throttle valve opening degree detecting sensor; and a throttle valve completely closing position detecting and correcting means detecting a stop of an operation of the combustion engine, operating the throttle valve to be in a completely closing position, detecting the completely closing position from the completely closing position signal from the throttle opening degree sensor, and correcting the target position signal, for a completely closing state, outputted from the target opening degree setting means by shifting the target position signal on a side of opening the throttle valve by a predetermined amount.

According to the second aspect of the present invention, there is provided the intake air flow rate controlling device, wherein the completely closing position detecting and correcting means detects the completely closing position and corrects the completely closing position learning value, outputted from the throttle valve completely closing position learning means.

According to a third aspect of the present invention, there is provided the intake air flow rate controlling device, wherein the completely closing position detecting and correcting means detects the completely closing position and corrects both of the target position signal for the completely closing state, outputted from the target opening degree setting means and a completely closing position learning value, outputted from the throttle valve completely closing position learning means.

According to a fourth aspect of the present invention, there is provided an intake air flow rate controlling means comprising: a throttle valve located in an intake air passage of a combustion engine; a motor controlling an intake air flow rate by operating an opening degree of the throttle valve; a motor driving means driving the motor; a throttle opening degree sensor detecting an opening degree of the throttle valve; a target opening degree setting means operating a target throttle opening degree, setting the opening degree of the throttle valve, and outputting the opening degree to the motor driving means as a target position signal; a throttle completely opening position learning means learning a completely opening position of the throttle valve from a completely opening position signal from the throttle opening degree sensor; and a throttle completely opening position detecting and correcting means detecting a stop of an operation of the combustion engine, controlling the throttle valve to be in a completely opening position, detecting the completely opening position by the completely opening position signal from the throttle opening degree sensor, and correcting the target position signal outputted from the target opening degree setting means in a completely opening state by shifting the target position signal on a side of closing the throttle valve from the completely opening position signal by a predetermined amount.

According to a fifth aspect of the present invention, there is provided the intake air flow rate controlling means, wherein the completely opening position detecting and correcting means detects the completely opening position and corrects a completely opening position learning value, outputted from the throttle valve completely opening position learning means.

According to a sixth aspect of the present invention, there is provided the intake air flow rate controlling device, wherein the completely opening position detecting and correcting means detects the completely opening position and corrects both of the target position signal outputted from the target opening degree setting means for the completely opening state and a completely opening position learning value outputted from the throttle valve completely opening position learning means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

A detailed explanation will be given of preferred embodiments of the present invention in reference to FIG. 1 through 6 as follows, wherein the same numerical references are used for the same or similar portions and descriptions of these portions is omitted.

Embodiment 1

Figure 1:
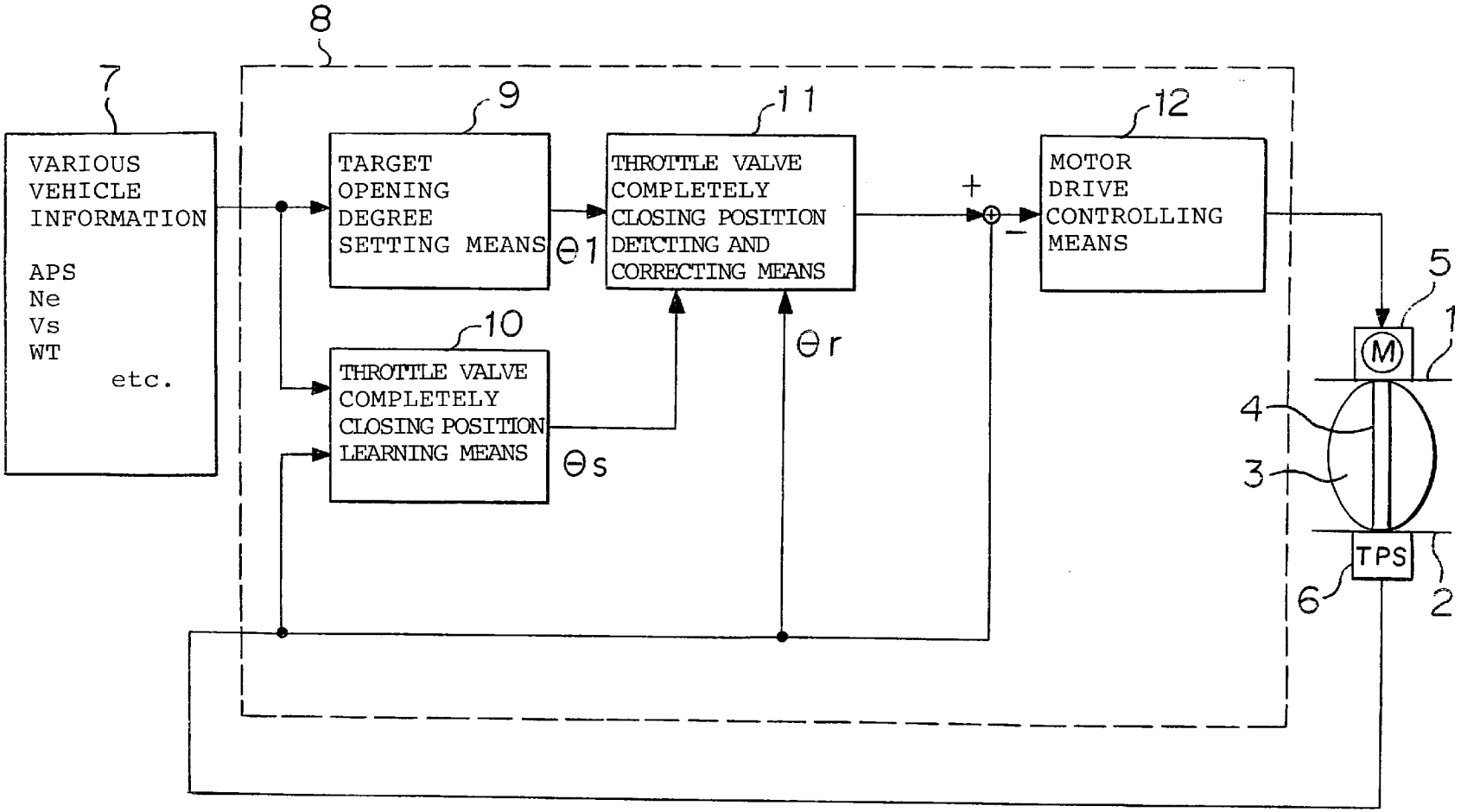
FIG. 1 is a block chart illustrating a structure of an intake air flow rate controlling device according to Embodiment 1 of the present invention.
Figure 2:
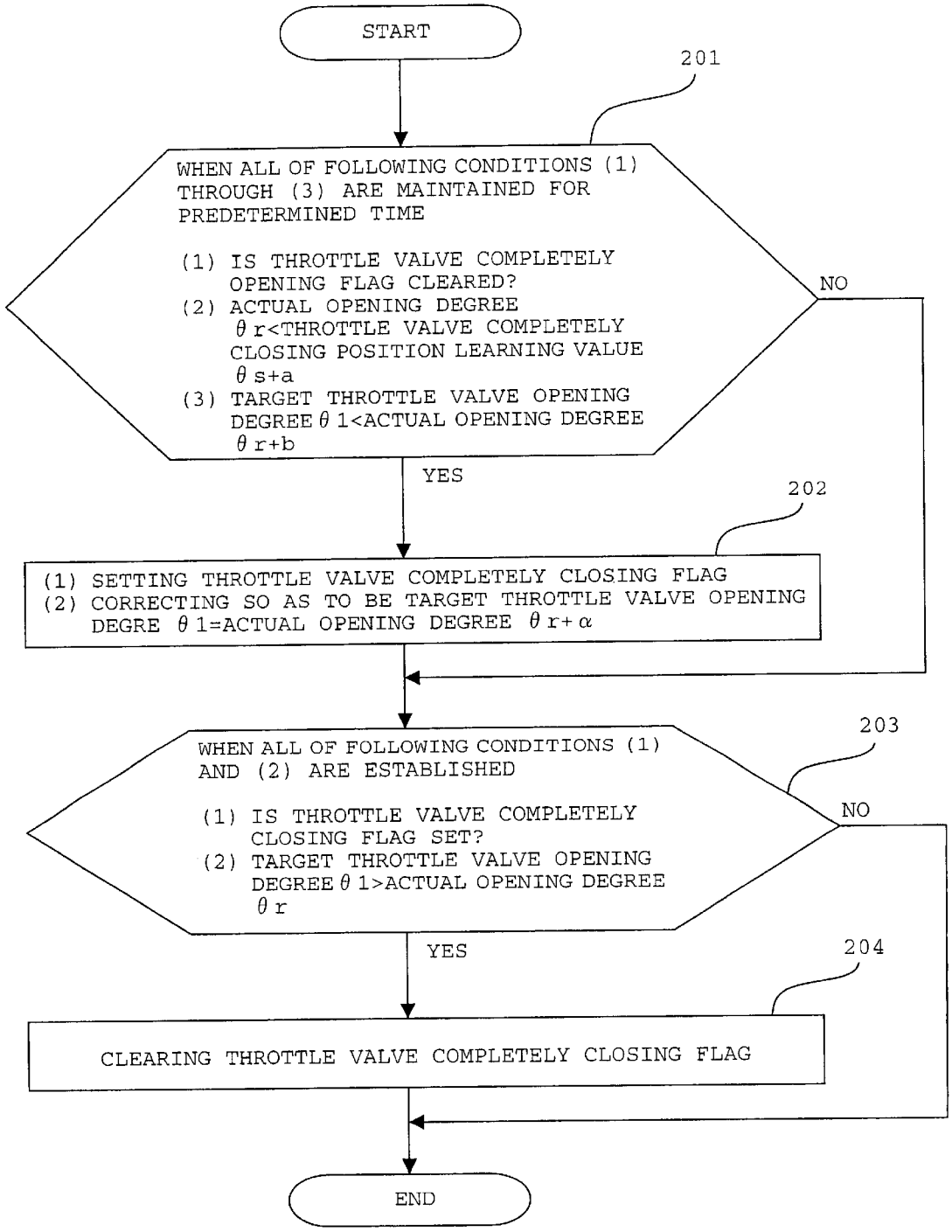
FIG. 2 is a flow chart illustrating an operation of the intake air flow rate controlling device according to Embodiment 1 of the present invention.
Figure 3:
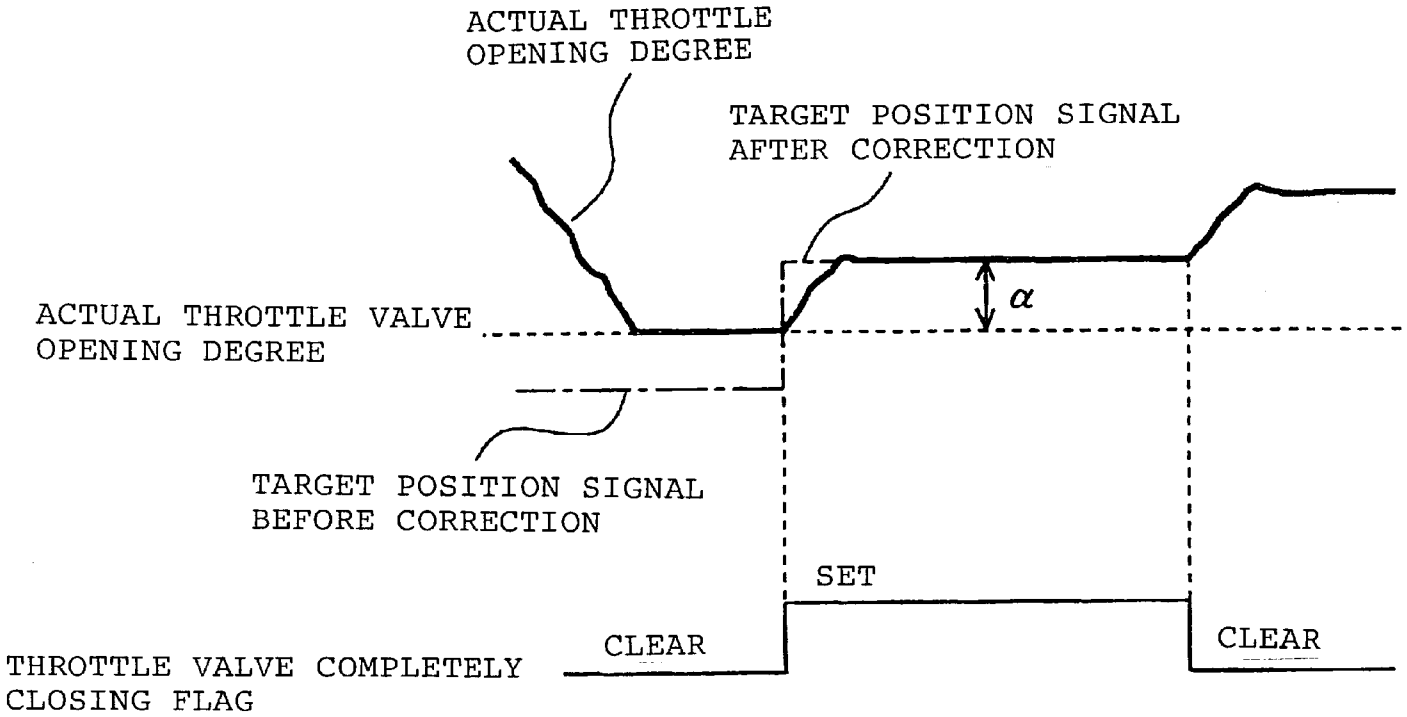
FIG. 3 is a time chart illustrating an operation of the intake air flow rate controlling device according to Embodiment 1 of the present invention.

FIGS. 1 through 3 illustrate an intake air flow rate controlling device according to the Embodiment 1 of the present invention. FIG. 1 is a block chart illustrating a structure of the intake air flow rate controlling device. FIG. 2 illustrates a flow chart illustrating an operation. FIG. 3 is a time chart illustrating the operation. In FIG. 1, numerical reference 1 designates a throttle actuator located in an intake air passage 2 of a combustion engine, not shown, wherein the throttle actuator includes a throttle valve 3, a throttle shaft 4 supporting the throttle valve, a motor 5 driving the throttle shaft 4 and opening and closing the throttle valve 3, and a throttle valve opening degree detecting sensor 6 detecting a rotational angle of the throttle shaft 4 and an opening degree of the throttle valve.

Numerical reference 7 designates various sensors equipped in a vehicle. Reference APS designates an accelerator opening degree sensor; reference Ne designates a rotational speed sensor of the combustion engine; reference Vs designates a vehicle speed sensor; and reference WT designates a cooling water temperature sensor. Vehicle information including outputs from these sensors and outputs from other sensors and so on is inputted into a control unit 8. The control unit 8 receives the inputs from these sensors and so on and a feedback signal from the throttle opening degree sensor 6, and operates a throttle opening degree in conformity with a learning condition of the combustion engine to drive the motor 5.

The control unit 8 is constructed as follows. Numerical reference 9 designates a target opening degree setting means, which sets a target throttle opening degree based on the information from the various sensors 7 and so on and outputs a target position signal. Numerical reference 10 designates a throttle valve completely closing position learning means, which learns a completely closing position of the throttle valve 3 from the information from the various sensors 7 and so on and a position signal from the throttle valve opening degree detecting sensor 6. Numerical reference 11 designates a throttle valve completely closing position detecting and correcting means, which receives the target position signal from the target opening degree setting means 9, a throttle valve completely closing position learning value from the throttle valve completely closing position learning means 10, and the position signal from the throttle opening degree sensor 6, detects an actual completely closing position of the throttle valve 3 as described below and compares the actual completely closing position with the position signal from the throttle valve opening degree detecting sensor 6, and corrects the target position signal from the target opening degree setting means 9. Numerical reference 12 designates a motor drive controlling means, which drives the motor based on a target position correcting signal from the throttle valve completely closing position detecting and correcting means 11 and the signal from the throttle valve opening degree detecting sensor 6 by a predetermined amount to operate a throttle valve opening degree.

In this intake flow rate controlling device according to Embodiment 1, at first when an ignition signal for the combustion engine is turned off to stop a rotation, the target opening degree setting means 9 outputs the target position signal θ1 for completely closing the throttle valve 3 in receipt of a signal stating that the rotational speed Ne of the combustion engine is 0, and the motor drive controlling means 12 drives the throttle valve 3 to be in a completely closed position in receipt of the target position signal θ1. When an output voltage from the throttle valve opening degree detecting sensor 6 is in a predetermined range after a predetermined time, a voltage value of the output voltage is read by the throttle valve completely closing position learning means 10, the throttle valve completely closing position learning means 10 learns the voltage value as the completely closing position signal θs, and the control unit 8 is operated as illustrated in the flow chart of FIG. 2.

In FIG. 2, in Step 201, it is judged whether or not the throttle valve position is in the completely closing state and whether or not a correction of the target position signal θ1 is necessary by a continuation of the following conditions for a predetermined time. The first condition is that a throttle valve completely closing flag is cleared, wherein the completely closing state of the throttle valve opening degree is not yet judged. The second condition is that a detected value θr from the throttle valve opening sensor 6 is smaller than a sum of the throttle valve completely closing position learning value θs and a predetermined value, where the predetermined value a is an allowance provided for a detection error and so on, wherein the completely closing state is confirmed by this condition. The third condition is whether or not the target position signal θ1 outputted from the target opening degree setting means 9 is smaller than a sum of the detected value θr from the throttle valve opening degree detecting sensor 6 and a predetermined value b, namely a judgment of whether or not the target position signal θ1 is on a side of a small opening degree from the detected value θr of the throttle valve opening degree detecting sensor 6, where a value of b is set to be larger than or equal to an insensitive range in the control. In this third condition, when θ1<θr+b is established, it is judged that a correction of the target position signal θ1 is necessary.

When the above conditions are continuously established for a predetermined time, these are judged that the throttle valve opening degree is in the completely closing state and the target position signal θ1 should be corrected, and Step 202 is processed. When these conditions are not established, these are judged that the throttle valve position is not in the completely closing state or the correction of the target position signal θ1 is unnecessary, and Step 203 is selected. In Step 202, because the throttle valve position is in the completely closing state, the throttle valve completely closing flag is set, and a value of the target position signal θ1 is corrected to a value of the sum of the detected value θr from the throttle valve opening degree detecting sensor 6 and a predetermined value α. The predetermined value α is estimated for an error in converting the output voltage from the throttle valve opening degree detecting sensor 6 by an A/D conversion and others. Because the detected value θr is detected when the throttle valve 3 is completely closed, the target position signal θ1 is corrected by shifting on a direction of opening the valve with respect to an actual completely closing position by the predetermined value α.

When a correcting process in Step 202 is completed, Step 203 is processed. In Step 203, it is checked whether or not the throttle valve completely closing flag is in a set state, and further it is judged whether or not the corrected target position signal θ1 is larger than the detected value θr from the throttle valve opening degree detecting sensor 6. If θ1>θr is established, in Step 204, the throttle valve completely closing flag is cleared because the opening degree of the throttle valve 3 escapes from the completely closing state, and the operation is finished. FIG. 3 is the time chart illustrating an operating state of the throttle valve 3 in this process.

When the ignition signal of the combustion engine is turned off and the rotation of the combustion engine is stopped in FIG. 3, the opening degree of the throttle valve 3 is driven to slide on a completely closing side, and the above-mentioned Step 201 is judged in a completely closing position. If this judgment is established, the throttle valve completely closing flag is set, the target position signal θ1 is corrected, whereby the throttle valve 3 is shifted to a position of opening by the predetermined value a from the completely closing position. This position is a corrected position as the target position signal at time of completely closing. Because the throttle valve 3 escapes from the completely closing position by this shift, the completely closing flag is cleared in Step 204, and the throttle valve 3 is shifted to a position of opening a predetermined amount from the target position signal θ1 at time of completely closing, whereby the correcting operation is completed.

As described, at each event that the ignition signal of the combustion engine is turned off and the rotation is stopped, a completely closing value of the target position signal is corrected, and the completely closing position is set as the position of opening the predetermined value α with respect to the actual completely closing position. Therefore, even though the detected value from the throttle valve opening degree detecting sensor 6 has an error, before reaching the actual completely closing position, the detected value from the throttle valve opening degree detecting sensor 6 is in agreement with the completely closing value of the target position signal, and a motor current is shut off, whereby burning of the motor 5 and a driving circuit caused by an excessive current can be prevented. Although, the target position signal θ1 is corrected in Step 202 in the above description, the throttle valve completely closing position learning value θs learnt by the throttle valve completely closing position learning means 10 may be corrected to judge the throttle valve position using the learning value θs, whereby an effect similar thereto is obtainable. Further, by correcting both of the learning value θs and the target position signal θ1, it is possible to securely obtain the effect.

Embodiment 2

Figure 4:
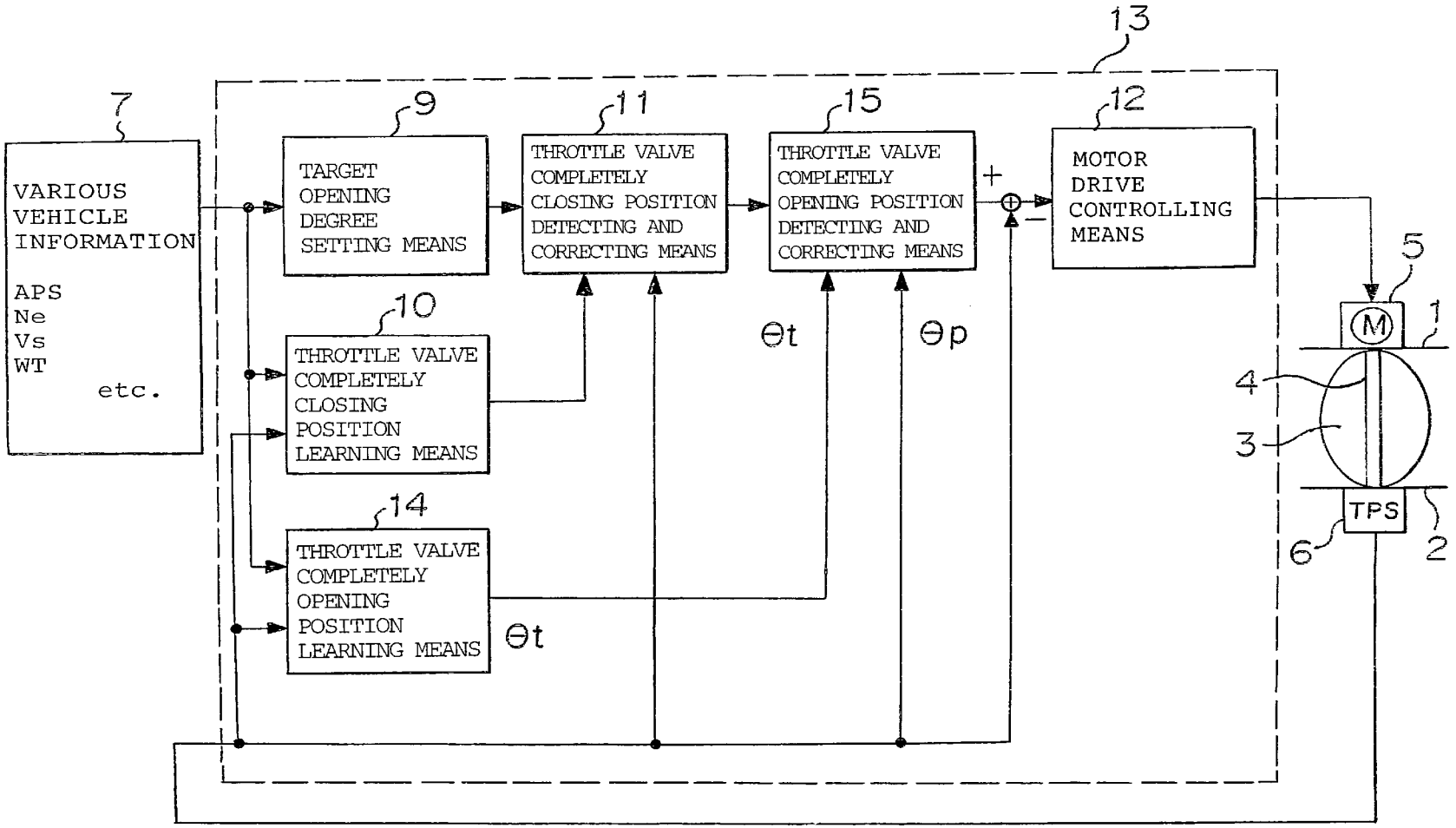
FIG. 4 is a block chart illustrating a structure of an intake air flow rate controlling device according to Embodiment 2 of the present invention.
Figure 5:
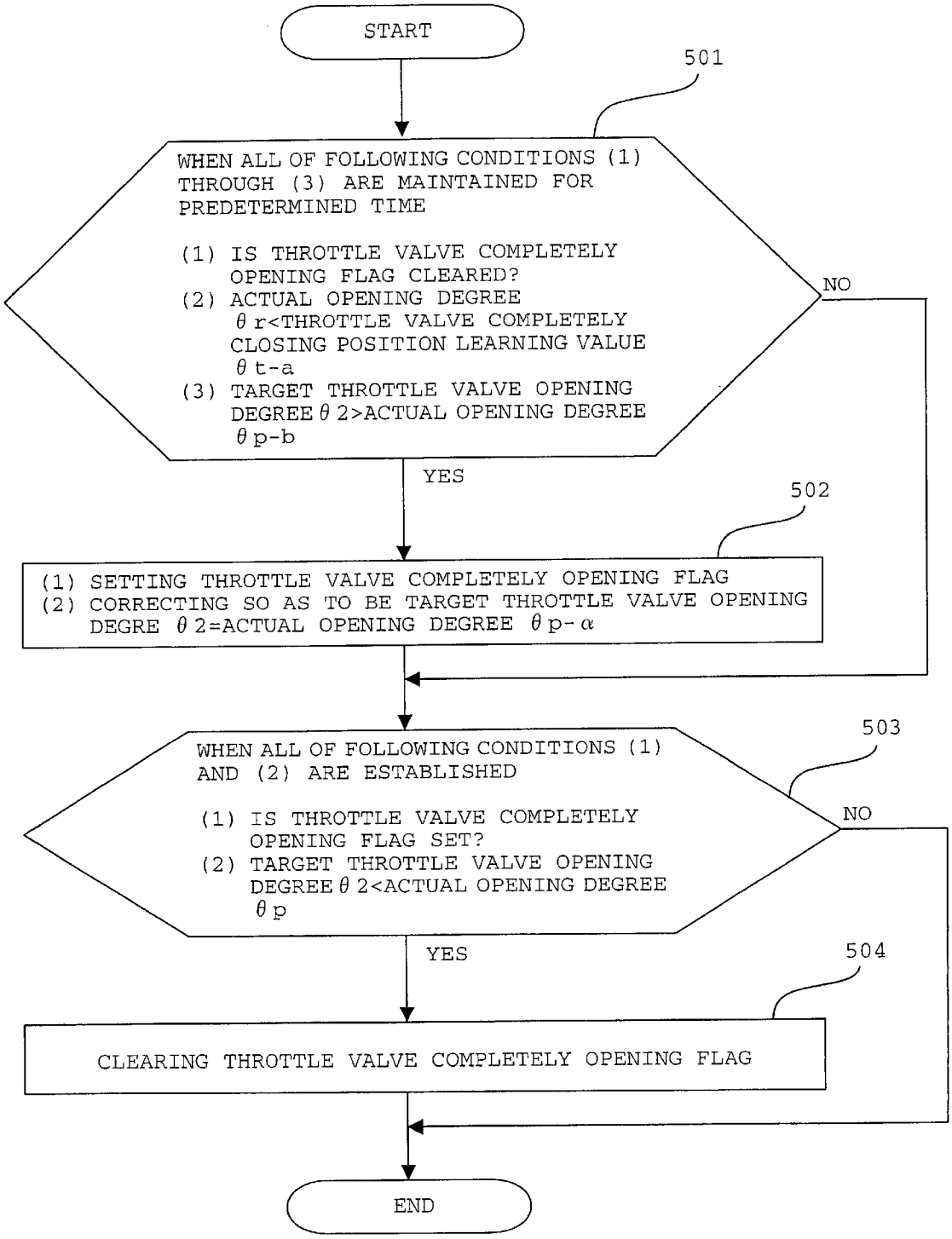
FIG. 5 is a flow chart illustrating an operation of the intake air flow rate controlling device according to Embodiment 2 of the present invention.
Figure 6:
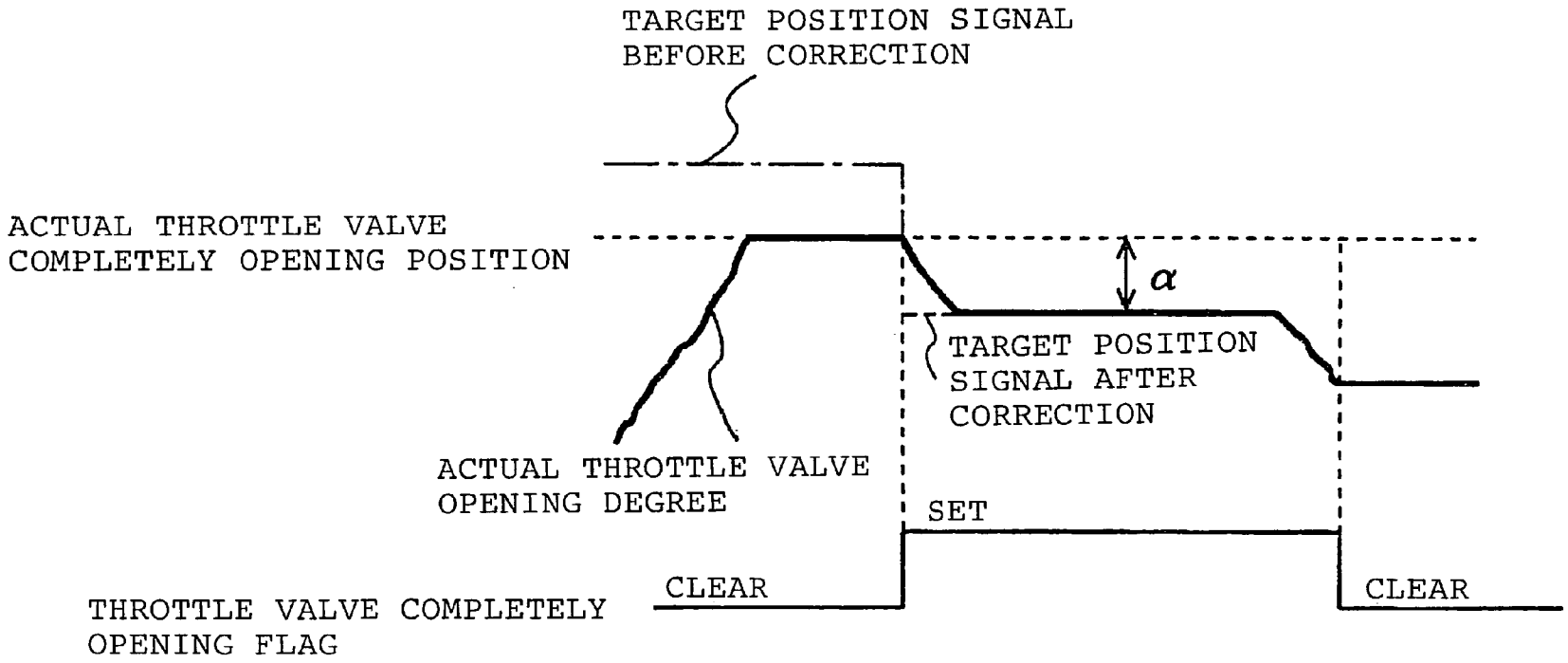
FIG. 6 is a time chart illustrating an operation of the intake air flow rate controlling device according to Embodiment 2 of the present invention.

FIGS. 4 through 6 illustrate an intake air flow rate controlling device according to the Embodiment 2 of the present invention. FIG. 4 is a block chart illustrating a structure; FIG. 5 is a flow chart illustrating an operation; and FIG. 6 illustrates a time chart explaining the operation. In this embodiment, in comparison with Embodiment 1, the control unit includes a throttle valve completely opening position learning means 14 learning a completely opening position of a throttle valve by information from various sensors and so on 7 and a position signal from the throttle valve opening degree detecting sensor; and a throttle valve completely opening position detecting and correcting means 15 receiving a target position signal inputted from the target opening degree setting means 9 through the throttle valve completely closing position detecting and correcting means 11, a throttle valve completely opening position learning value from the throttle valve completely opening position learning means 14, a position signal from the throttle valve opening degree detecting sensor 6, detecting an actual completely opening position of the throttle valve 3 as described below, comparing the signal from the throttle valve opening degree detecting sensor 6 with the actual completely opening position, and correcting a completely opening value of the target position signal from the target opening degree setting means 9.

In thus constructed intake air flow rate control device according to Embodiment 2, in addition to the above-mentioned correction of the completely closing position of the target position signal, the correction is operated by the intake air flow rate control device according to Embodiment 1, the following operations are added. At first, when an ignition signal for a combustion engine is turned off and a rotation of the combustion engine is stopped, the target opening degree setting means 9 outputs a target position signal θ2 for completely opening the throttle valve 3 in receipt of a signal stating that the rotational speed Ne of the combustion engine is 0, the motor drive controlling means 12 receives the target position signal θ1 and drives the throttle valve 3 on a side of completely opening. When an output voltage from the throttle valve opening degree detecting sensor 6 is within a predetermined range after a predetermined time, a voltage value at that time is read by the throttle valve completely opening position learning means 14, the throttle valve completely opening position learning means learns the voltage value as the completely opening position signal θt, and the control unit 13 is operated as illustrated in the flow chart of FIG. 5.

In FIG. 5, these are judged whether or not the throttle valve position is in the completely opening state and whether or not a correction of the target position signal θ2 is necessary by a continuation of the following conditions for a predetermined time in Step 501. The first condition is that a throttle valve completely opening flag is cleared, wherein the completely opening position of the throttle valve opening degree is not yet judged. The second condition is that the detected value θp from the throttle valve opening degree detecting sensor 6 is larger than a valve obtained by subtracting a predetermined value a from the throttle valve completely opening position learning value θt, where the predetermined value a is an allowance provided for detection errors and so on at time of completely closing and completely opening the throttle valve, whereby it is possible to confirm whether or not the throttle valve is in the completely opening state. The third condition is a judgment of whether or not a target position signal θ2 outputted by the target position setting means 9 is larger than a value obtained by subtracting a predetermined value b from the detecting value θp from the throttle valve opening degree detecting sensor, wherein it is judged whether or not the target throttle opening degree is on a side of widely opening the throttle valve with respect to the detecting position θp from the throttle valve opening degree detecting sensor 6, where a valve b is set to be larger than or equal to a value in an insensitive range in the control. When θ2<θp−b is established in the third condition, it is judged that the correction of the target position sensor θ2 is necessary.

When the above-mentioned conditions continue for the predetermined time, these are judged that the throttle valve opening degree is in the completely opening state, and a correction of the target position signal θ2 is required, and Step 502 is processed. When the condition is not established, it is judged that the throttle valve position is not in the completely opening state or the correction of the target position signal θ2 is not required, and Step 503 is selected. In Step 502, because the actual throttle valve position is judged in the completely opening state in Step 501, a throttle valve completely opening flag is set, and a value of the target position signal θ2 is corrected to be a value obtained by subtracting a predetermined value from the detected value θp from the throttle valve opening degree detecting sensor 6. The predetermined value a is similar to that in Embodiment 1, and the detected value θp corresponds to an operation of completely opening the throttle valve 3, whereby the target position signal θ2 is corrected such that the target position signal θ2 is shifted on a side of closing the throttle valve by the predetermined value α with respect to the actual completely opening position.

When a process of the correction is completed in Step 502, Step 503 is processed to confirm whether or not the throttle valve completely opening flag is in the set state, and further, it is judged whether or not the corrected target position signal θ2 is smaller than the detected value θp from the throttle valve opening degree detecting sensor 6. If θ2<θp is established the opening degree of the throttle valve 3 is judged to escape from the completely opening state in Step 504, the throttle valve completely opening flag is cleared and the operation is finished. An operating state of the throttle valve 3 in this process is illustrated in the time chart of FIG. 6.

When an ignition signal of the combustion engine is turned off and a rotation of the combustion engine is stopped in FIG. 6, the opening degree of the throttle valve 3 is driven on a side of completely opening to be slid, and the above-mentioned judgment in Step 501 is processed in a completely opening position. If the judgment is established, a throttle valve completely opening flag is set, the target position signal θ2 is corrected, and the throttle valve 3 is shifted from the completely opening position on a side of closing the throttle valve by the predetermined value α, wherein the shifted position is the corrected position as the target position signal at time of completely opening. By this shift, because the throttle valve escapes from the completely opening position, the completely opening flag is cleared in Step 504, the throttle valve 3 is shifted to a position of closing the predetermined amount from the position of the target position signal θ2 at time of completely opening, and the correcting operation is completed.

As described, at each event that the ignition signal of the combustion engine is turned off and the rotation is stopped, the target position signal is corrected, and the throttle valve is set on a side of closing by the predetermined value α from the actual completely opening position, whereby even though the detected value of the throttle valve opening degree detecting sensor 6 has an error, the completely opening state is judged before actually reaching the completely opening position, and a motor current is shut off to prevent burning of the motor 5 and a driving circuit caused by an excessive current can be prevented. Meanwhile, in the above description, although the target position signal θ2 is corrected in Step 502, an effect similar to that in Embodiment 1 is obtainable by correcting the throttle valve completely opening position learning value θt learnt by the throttle valve completely opening position learning means 14 and judging the throttle valve position using the learning value θt. Further, by correcting both of the learning value θt and the target position signal θ2, the effect can be secured.

The first advantage of the intake air flow rate controlling device according to the present invention is that the target throttle opening degree can be corrected at high frequency.

The second advantage of the intake air flow rate controlling device according to the present invention is that the target throttle valve position signal does not exceed an operating range of the throttle valve at time of completely closing and completely opening the throttle valve, whereby burning of the motor and the driving circuit for controlling the throttle valve, caused by an excessive current, can be securely prevented.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application No. 2000-151644 filed on May 23, 2000 including specification, claims, drawings and summary are incorporated herein by reference in its entirety.

What is claimed is:

1. An intake air flow rate controlling device, comprising:

a throttle valve located in an intake passage of a combustion engine;

a motor that controls an intake air flow rate by controlling an opening degree of the throttle valve;

a motor driving means for driving the motor;

a throttle valve opening degree detecting sensor;

a target opening degree setting means for outputting a target throttle valve opening degree as a target position signal to the motor driving means for setting the opening degree of the throttle valve;

a throttle valve completely closing position learning means for learning a completely closed position of the throttle valve from a completely closed position signal from the throttle valve opening degree detecting sensor, and for outputting a corresponding closed position learning value; and a throttle valve completely closing position detecting and correcting means for detecting a stop of an operation of the combustion engine, for operating the throttle valve to be in a completely closed position, for detecting the completely closed position from the completely closed position signal from the throttle valve opening degree detecing sensor, and for correcting the target position signal, for a completely closed state, outputted from the target opening degree setting means by shifting the target position signal on a side of opening the throttle valve by a predetermined amount.

2. The intake air flow rate controlling device according to claim 1, wherein the throttle valve completely closing position detecting and correcting means detects the completely closed position and corrects the completely closed position learning value outputted from the throttle valve completely closing position learning means.

3. The intake air flow rate controlling device according to claim 1, wherein the completely closing position detecting and correcting means detects the completely closed position and corrects both of the target position signal outputted from the target opening degree setting means for the completely closed state and the completely closed position learning value outputted from the throttle valve completely closing position learning means.

* * * * *